United States Patent [19]

Schmid

[11] Patent Number: 4,793,157

[45] Date of Patent: Dec. 27, 1988

[54] FLAT KNITTING MACHINE

[75] Inventor: Franz Schmid, Bodelshausen, Fed. Rep. of Germany

[73] Assignee: H. Stoll GmbH & Co., Reutlingen, Fed. Rep. of Germany

[21] Appl. No.: 143,046

[22] Filed: Jan. 12, 1988

[30] Foreign Application Priority Data

Jan. 31, 1987 [DE] Fed. Rep. of Germany ..... 3702881

[51] Int. Cl.[4] ..... D04B 7/00

[52] U.S. Cl. ..... 66/75.2

[58] Field of Search ..... 66/64, 75.2

[56] References Cited

FOREIGN PATENT DOCUMENTS 2320845 4/1973 Fed. Rep. of Germany ..... 60/75.2

2136152 9/1984 United Kingdom ..... 66/75.2

*Primary Examiner*—Ronald Feldbaum

*Attorney, Agent, or Firm*—Larson and Taylor

[57] ABSTRACT

In the flat knitting machine the trailing cable (15) supplying electricity to the drivable machine carriage (10) is guided over at least one trailing cable holder (17) which is movable simultaneously with the carriage, the cable thus forming at least two cable loops. When the machine carriage (10) is on short stroke, these cable loops are prevented from swaying by a support arrangement having, at least between the cable end (21) at the carriage (10) and the cable holder (17), two linked guides (22, 23) whose total length is approximately the same as the length of the cable loop to be supported and with which the cable (15) is coupled at least one point (FIG. 1).

5 Claims, 1 Drawing Sheet

FLAT KNITTING MACHINE

Figures 1, 2:
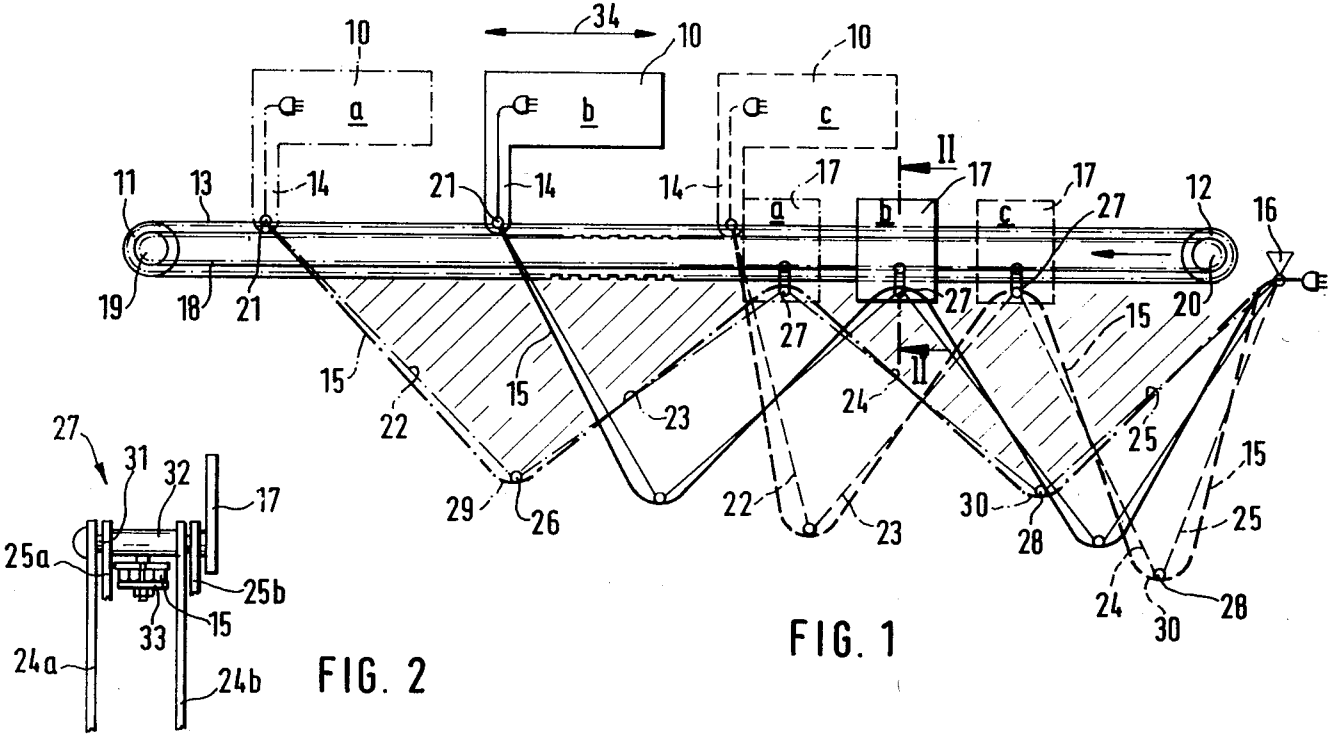

The invention concerns a flat knitting machine with a drivable machine carriage to which electrical energy and/or control signals are conveyed via at least one trailing cable, with at least one trailing cable holder displaceable parallel to the carriage track simultaneously with the carriage and arranged between the end of the trailing cable on the carriage and the end of the trailing cable on the machine frame.

The trailing cable holders prevent the trailing cable from sagging to the floor and also, when the cable holders are being driven, relative the trailing cable from relatively strong tension loads and avoid collision of several cable holders which may lead to intensified bending of the cable. It has been shown, however, that when the carriage is on short stroke operation for shaped knitting, the trailing cable with its freely supported cable loops can go into vibrations which subject the individual cable or cable harness of the trailing cable to strong alternating stresses and can also cause the cable to sway out of its plane of movement and to knock against neighbouring machine parts.

The invention sets out to arrange a trailing cable for the carriage of a flat knitting machine in such a way that in any operating conditions, including short stroke operation, the cable loops are prevented from undesired swaying.

This problem is solved, in a flat knitting machine of the type mentioned in the introduction, by arranging two linked guides, at least between the cable end on the carriage and the cable holder in the cable plane, for the purpose of supporting the cable, the total length of which guides is about the same as the length of the cable loop to be supported.

The guides in each case form an adjustable angle with rigid angle arms with which the trailing cable loops can be connected with clearance. Where the cables are relatively thick, it is generally sufficient, for the coupling, to support the cable on the connecting hinge point of the two linked guides, which is situated inside a cable loop and on which can be advantageously arranged a bent bridge piece for the cable to rest on at whatever is the lowest point of a cable loop.

The two linked guides can each advantageously consist of two guide bridge pieces parallel to each other on one and the other longitudinal side of a cable loop and coupled together at their ends at the hinge points by a common hinge axis. In this embodiment, the cable loops between the pairs of guide bridges are particularly well safeguarded against lateral swaying out of the cable movement plane, and the guide linkage itself has increased stability in the cable movement plate.

The following is a more detailed explanation of an embodiment of a trailing cable support arrangement constructed according to the invention, with reference to the accompanying drawings which shows in FIG. 1 a diagrammatic side view of a trailing cable support arrangement for a flat knitting machine in various carriage positions;

FIG. 2 a cross-section through a trailing cable holder along the line II—II of FIG. 1.

In the diagram in FIG. 1, the carriage 10 of a flat knitting machine is shown in three different positions a, b and c of its displacement path on a carriage track which is not shown. The carriage's drive includes a connecting arm 14 by means of which the carriage is coupled to a toothed drive belt 13 passing around drive and guide rollers 11 and 12. The connecting arm 14 is also used to convey to the carriage 10 a trailing cable 15 which forms the electrical connection between the carriage 10 and a fixed junction point 16 on the machine frame, the rest of which frame is not shown. In the centre of its length the cable 15 is guided over a cable holder 17 movable parallel to the carriage 10 and also shown in three different positions a, b and c. The cable holder 17 is also coupled with an endless drive belt 18 which is guided over wheels 19, 20 coaxial with the guide and drive wheels 11 and 12. The diameter ratio of the wheels 11 and 19 and/or 12 and 20 is selected to be such that when the mutual drive shaft makes a revolution, the toothed drive belt 18 covers only half the distance of that covered by the drive belt 13. Thus the cable holder moves at half the speed of the displacement of the carriage 10.

The cable 15 is shown in each of the three positions a, b and c of the carriage 10 and of the cable holder 17. To differentiate these positions, the carriage 10, the cable holder 17 and the cable 15 have been drawn respectively with a dash-dotted line in position a, a continuous line in position b and a dotted line in position c. The cable holder 17 divides the cable 15, between its two end points, one 16 at the machine frame and the other 21 at the carriage, into two sagging cable loops. These two cable loops are indicated in FIG. 1 in position a of the carriage by oblique shading. The shading shows a triangular loop shape, not a curved loop which would be the case with an entirely freely suspended cable. The triangular shape is enforced by a support arrangement which, on each cable loop, consists of guides 22 and 23, 24 and 25 respectively, indicated by simple dashes in FIG. 1. One end of the guide 22 is hinged to the connecting arm 14 of the carriage 10 at the cable end point 21 and the other end is, at point 26, in hinged connection with one end of the adjoining guide 23 whose other end is coupled with the cable holder 17 at a hinge point 27. In the case of the second pair of linked guides 24 and 25, one end of the guide 24 is coupled with the hinge point 27 of the cable holder 17. The connection of the two guides 24 and 25 forms a hinge point 28 corresponding to the hinge point 26, and the other end of the guide 25 is hinged to the end point 16 of the cable 15 at the frame of the flat knitting machine. At each of the guide connection points 26 and 28 is arranged a bent bridge piece 29 or 30 against whose exterior the cable 15 comes to rest and which forms a guiding support for the cable 15.

FIG. 2 shows an arrangement for the hinge point 27 of the cable holder 17. The actual hinge point is formed by a spindle 31 on the central part of which is arranged a bearing sleeve 32 on which is secured a screw clamp arrangement 33 for the cable 15 consisting of four individual cable harnesses or branches. The guides 24 and 25, one end of each of which is mounted on the axle 31, each consist, in this embodiment, of two parallel guide bridge pieces 24*a* and 24*b*, 25*a* and 25*b* respectively at a distance from each other on both sides of the cable 15. The cable 15 thus extends in both cable loops between boundary planes formed by the two bridge pieces of the guides 22–25.

The cable 15 resting against the support arrangement at the hinge connection points 26 and 28 prevents the cable loops, even when the carriage 10 makes a rapid short-stroke movement in the direction of the double arrow 34 in FIG. 1, from swaying in the cable movement plane and also crom laterally swaying out of the movement plane. The cable 15 can also be loosely connected at other points, with clearance, with the guides 22–25, thus engaging the cable 15 to move in relation to the guides 22–25 when the distance of the hinge points 21 and 27, 27 and 16, is changed.

It is understood that the invention is also effective with trailing cables where no movable cable holders are provided and the cable therefore forms only a single loop between carriage and machine frame.

I claim:

1. Flat knitting machine with a drivable machine carriage to which electrical energy and/or control signals are conveyed via at least one trailing cable, with at least one trailing cable holder displaceable parallel to the carriage track simultaneously with the carriage and arranged between the cable end on the carriage and that on the machine frame, characterised by the arrangement, at least between the cable end (21) on the carriage (10) and the cable holder (17) in the plane of the trailing cable, of two linked guides (22, 23; 24, 25) for supporting the cable (15), the total length of which guides corresponds approximately to the length of the cable loop to be supported and with which guides the trailing cable (15) is coupled at at least one point.

2. Flat knitting machine according to claim 1, characterised in that each of the two linked guides (22, 25) consists of two parallel guide bridges (24*a*, 24*b*; 25*a*, 25*b*) spaced at one and the other longitudinal side respectively of the trailing cable (15) and coupled together at their ends at hinge points (21, 26, 27, 28, 16) by a mutual hinge spindle (31).

3. Flat knitting machine according to claim 1, characterised in that the hinge connection point (26, 28) of the two linked guides (22, 23; 24, 25) is situated within the cable loop.

4. Flat knitting machine according to claim 1 characterised in that, at the hinge connection point (26, 28) of the two linked guides (22, 23; 24, 25), of a bent bridge piece (29; 30) for the trailing cable (15) rest on with whatever is the lowest point of a cable loop.

5. Flat knitting machine according to claim 1, characterised in that the trailing cable (15) is connected with clearance with the guides (22–25) at distances.

* * * * *